US005553408A

United States Patent [19]

Townsend

[11] Patent Number: 5,553,408

[45] Date of Patent: Sep. 10, 1996

[54] EXCAVATOR BUCKET ATTACHMENT

[76] Inventor: Edward H. Townsend, P.O. Box 958, Big Fork, Mont. 59911

[21] Appl. No.: 426,108

[22] Filed: Apr. 21, 1995

[51] Int. Cl.[6] ..... E02F 3/76

[52] U.S. Cl. ..... 37/406; 414/722

[58] Field of Search ..... 37/405, 406, 407, 37/902, 903, 904, 468; 403/375; 414/722, 724, 725, 729; 299/67

[56] References Cited

U.S. PATENT DOCUMENTS

| | | | |
|---|---|---|---|
| 3,353,285 | 11/1967 | Murray | 37/2 |
| 3,807,589 | 4/1974 | Shovick | 214/147 R |
| 3,896,569 | 7/1975 | Thompson et al. | 414/722 X |
| 4,131,381 | 12/1978 | Alberts | 403/375 X |
| 4,283,866 | 8/1981 | Ogawa | 37/117.5 |
| 4,375,345 | 3/1983 | Hanson | 414/722 |
| 4,407,626 | 10/1983 | Bruckner | 414/741 |
| 4,519,739 | 5/1985 | Risch | 414/721 |
| 4,550,512 | 11/1985 | Felstet | 37/117.5 |
| 4,635,386 | 1/1987 | Kobayasi | 37/117.5 |
| 4,770,597 | 9/1988 | Powers | 414/741 |
| 4,799,852 | 1/1989 | Ramun | 414/721 |
| 4,803,788 | 2/1989 | Sorenson | 37/117.5 |
| 4,804,309 | 2/1989 | Risch | 414/704 |
| 4,820,112 | 4/1989 | Mullican | 414/704 |
| 4,845,867 | 7/1989 | Albrecht | 37/468 X |
| 4,858,346 | 8/1989 | Schulte | 37/184 |
| 4,932,832 | 6/1990 | McCasland et al. | 414/732 |
| 5,111,602 | 5/1992 | Risch | 37/117.5 |
| 5,114,299 | 5/1992 | Roche et al. | 414/722 |

FOREIGN PATENT DOCUMENTS

| | | | |
|---|---|---|---|
| 1106021 | 3/1968 | United Kingdom | E02F 3/32 |
| 2043586B | 1/1983 | United Kingdom | E02F 3/81 |

*Primary Examiner*—Terry Lee Melius
*Assistant Examiner*—Robert Pezzuto
*Attorney, Agent, or Firm*—Harry M. Cross, Jr.

[57] ABSTRACT

An excavating bucket attachment assembly comprises a pair of side arms and a tooth-mounting box mountable to an excavating bucket pivot pin without removing either the pivot pin or an excavating bucket to which the pivot pin is attached, and at least one tooth mounted in the tooth-mounting box. The tooth-mounting box comprises a transverse member providing a teeth-mounting channel that extends between the side arms with the side arms attached to the transverse member and closing off the channel at opposite ends thereof. A tooth retaining pin removably-extends through the tooth and through the side arms for retaining the tooth in the channel. The assembly may includes a plurality of clamping teeth, each mounted in the box by the retaining pin, and includes spacers located between adjacent teeth, the retaining pin extending through the spacers to hold the spacers between the teeth. Alternately, the assembly may include a ripping tooth mounted in the box by the retaining pin. The assembly also includes a pair of collars constructed to fit over ends of the pivot pin with the pivot pin protruding beyond the collars. The side arms are each provided with a forked end defining a slot that may be inserted over the ends of the pivot pin adjacent to one of the collars and fastened thereto.

9 Claims, 4 Drawing Sheets

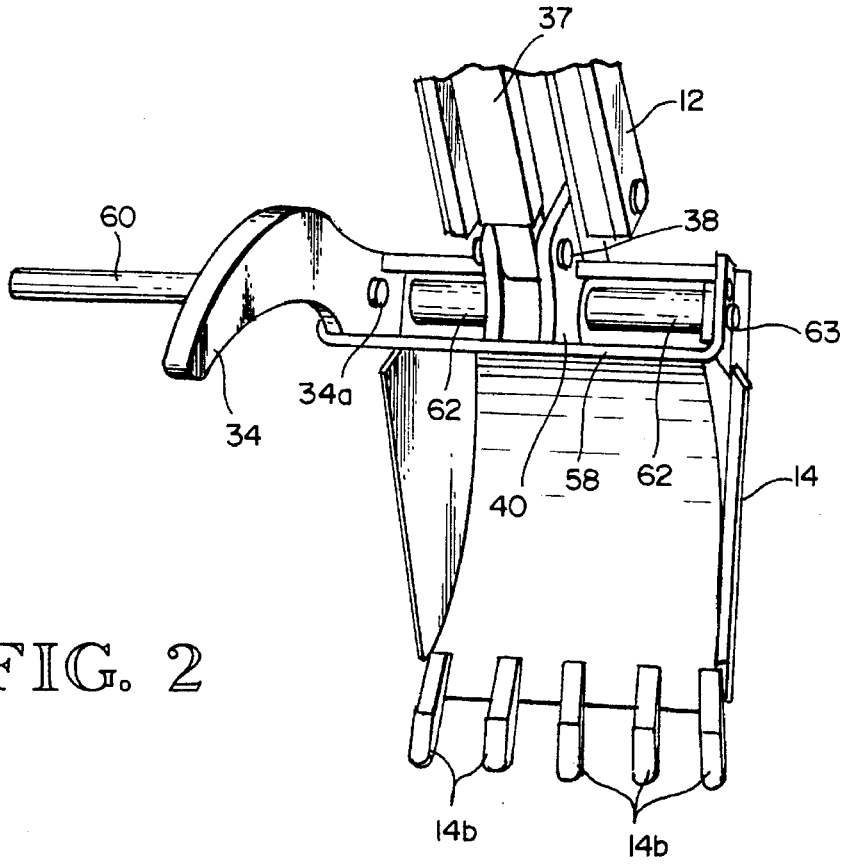
FIG. 2
FIG. 3
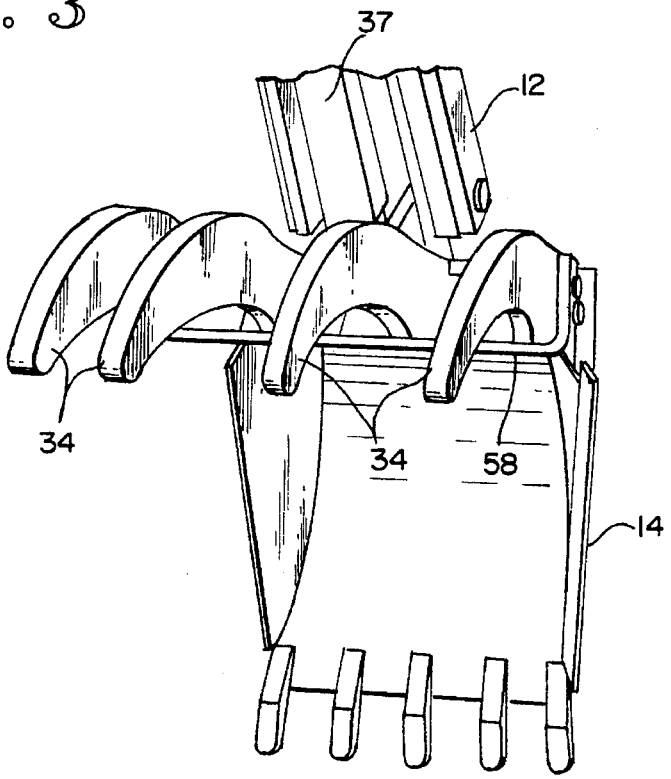

EXCAVATOR BUCKET ATTACHMENT

BACKGROUND OF THE INVENTION

1. Field of the Invention

This invention relates to material handling excavator buckets and, more particularly, to attachment assemblies for use with excavator buckets that function much like a "thumb" to enable an excavator operator to grab or grip an object between an excavator bucket and the clamping assembly, and for use with excavator buckets that function much like a "claw" to enable an excavator operator to break or rip through a hard-surfaced material.

2. Brief Description of the Prior Art

Backhoes and other similar excavator machines that employ excavating buckets have been fitted with mechanical attachments, such as clamping assemblies to enable a machine operator to grab or pickup an object by gripping the object between the bucket and the clamping assembly, or with ripping assemblies to enable a machine operator to break rip through a hard-surfaced material. Backhoe buckets typically open rearward toward the operator and are designed to be loaded toward the operator.

Clamping assemblies heretofore have been mounted to the the dipstick boom—bucket connection between the operator and the bucket so that the bucket could be pivoted outward away from the clamping assembly for positioning over an object, and so that the bucket could then be pivoted rearward toward the clamping assembly for grabbing the object. Such a clamping assembly functions much like a "thumb" to enable the machine operator to pick up an object that could not be conveniently picked up by the bucket alone. For example, where a backhoe would be employed to dig a cavity for a utility vault, with the provision of a suitable bucket clamping assembly the backhoe operator could grab the utility vault and set it into the cavity without requiring the use of other machines or equipment. Likewise, the provision of a suitable bucket clamping assembly could permit the backhoe operator to conveniently grab a boulder or other object and lift it out of the way or place it in a desired location.

Ground-breaking attachments, such as cutting or breaking "claws", have been mounted to the end of an excavator "dipstick" boom, in place of the excavator bucket assembly, so that the excavator could be employed to break up, or rip through, ground or pavement that could not be broken up by the bucket assembly by itself. For example, the ground or pavement might be too hard for a bucket, having muliple teeth that share the downward force of the dipstick action and so dissipate the breaking or cutting force of the bucket teeth. Or, the ground or pavement may have to be broken or cut along a relatively narrow path, narrower than the width of the bucket teeth so that the bucket could not be usefully employed in that case.

Bucket clamping assemblies, i.e. bucket "thumbs", that have been heretofore proposed have suffered from any one of a number of deficiencies. Some such thumbs have either required permanent mounting to the excavator bucket or have required disassembly of the bucket mounting to remove the thumb from the bucket. Other such thumbs have fixed, unalterable arrangement of pickup teeth which renders the thumb awkward or impossible to use for picking up certain kinds or shapes of objects.

Excavator breakers or rippers that have been hertofore proposed have also suffered from any one of a number of deficiencies. Substitution of a breaking or ripping "claw" for the bucket assembly can be uneconomical in that the attachment assembly for both a bucket and a cutter or breaker "claw" requires a duplication of elements. Also, having to replace the bucket with a "claw" is a time-consuming procedure.

And, heretofore, there has been no mechanically-simple attachment for an excavator bucket that could be employed to provide either a gripping "thumb" or a ripping "claw", of both.

SUMMARY OF THE INVENTION

It is a primary object of the present invention to provide an excavator bucket attachment assembly that can be easily installed or removed from an excavator machine without having to disassemble the bucket from the excavator machine. This attachment assembly may provide for a clamping assembly, or a ripping assembly, or both. Another object is to provide such an attachment assembly with removable gripping teeth that can be easily installed and removed without having to disassemble either the bucket or the clamping assembly from the excavator machine. Still another object is to provide such an attachment assembly with removable breaking or ripping teeth that can be easily installed and removed without having to disassemble either the bucket or the attachment assembly from the excavator machine. A further object is to provide such an attachment assembly that can be used by relatively light-weight backhoe machine buckets and that can be quickly transferred from one machine to another by a single individual. These and other objects and advantages will become apparent from the following description of the preferred embodiment of the invention.

In accordance with these objects, the invention provides an excavating bucket attachment assembly comprising mounting means including a pair of side arms and a mounting box, attaching means for attaching the side arms to an excavating bucket pivot pin without having to remove either the pivot pin or an excavating bucket to which the pivot pin is attached, and at least one elongated member, in the form of a gripping tooth or a ripping tooth, mounted in the mounting box for use in conjunction with the bucket. The mounting box comprises a transverse member providing a mounting channel that extends between the side arms with the side arms attached to the transverse member and closing off the channel at opposite ends thereof. A retaining pin removably-extends through the elongated member and through the side arms for retaining the elongated member in the channel. The assembly, when employed as a bucket "thumb", preferably includes a plurality of elongated gripping teeth, each mounted in the box by the retaining pin, and includes spacers located between adjacent members, the retaining pin extending through the spacers to hold the spacers between the members. The assembly, when employed as a bucket "claw", preferably includes one or more elongated ripping teeth, each mounted in the box by the retaining pin. The assembly attaching means includes a pair of collars constructed to fit over ends of the pivot pin with the pivot pin protruding beyond the collars, the collars each being provided with at least one threaded bolt hole. The side arms are each provided with a forked end defining a slot and at least one bolt hole so that the slots of the side arms may be inserted over the ends of the pivot pin adjacent to one of the collars and so that the side arm bolt hole could be aligned with the threaded hole in the adjacent collar and fastened thereto by a bolt inserted into both aligned holes.

BRIEF DESCRIPTION OF THE DRAWINGS

FIG. 2 is a perspective view from the rearward, bucket-cavity end of the FIG. 1 apparatus, illustrating the removal and insertion of gripping teeth for the bucket thumb assembly of this invention;

FIG. 3 is a perspective view from the same perspective as in FIG. 2 illustrating the thumb assembly fitted with a full complement of gripping teeth;

DESCRIPTION OF THE PREFERRED EMBODIMENT

Figure 1:
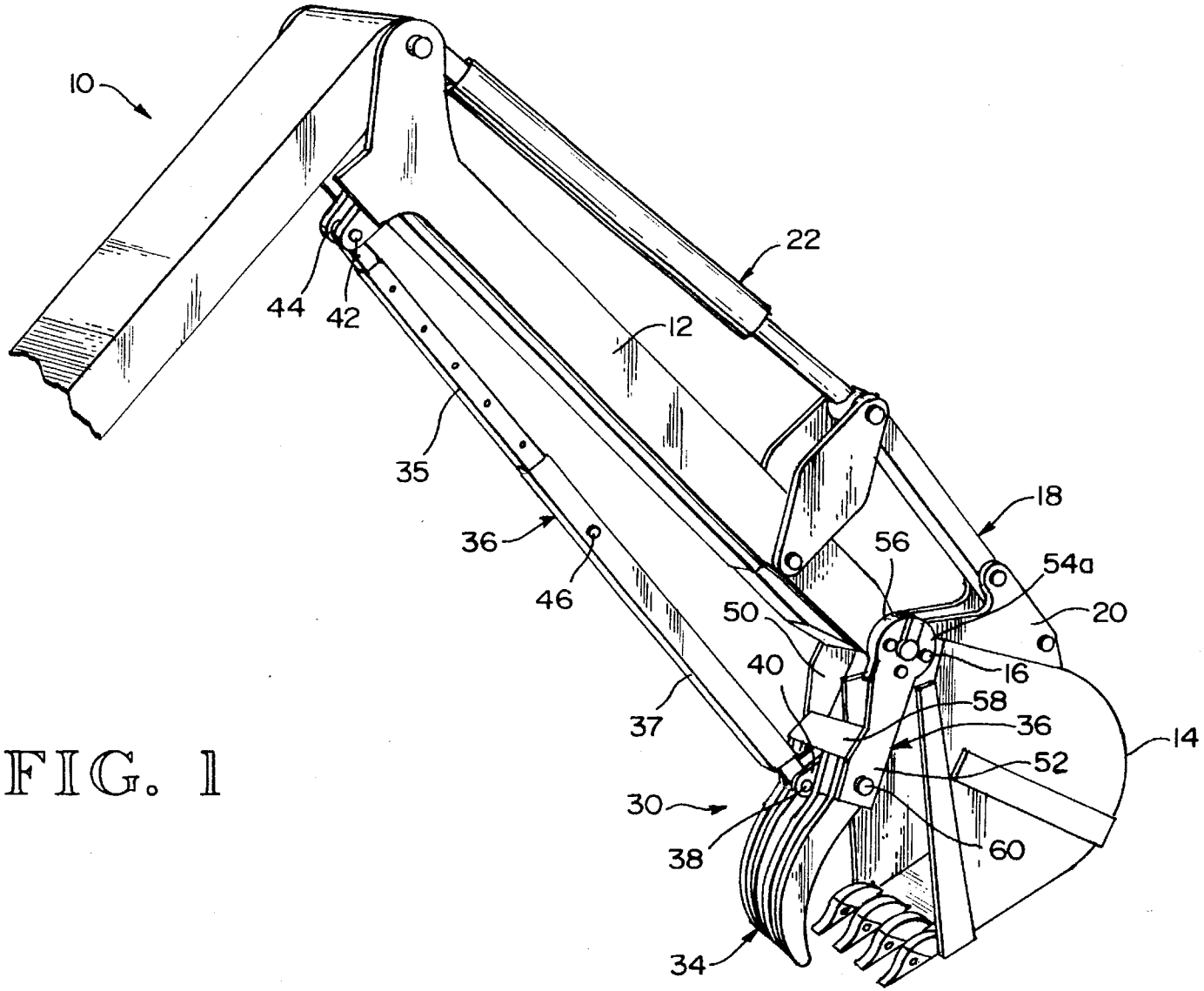
FIG. 1 is a perspective view of a backhoe excavator dip stick with a bucket mounted thereon and with the "thumb" assembly of the present invention mounted to the bucket.

With reference to FIG. 1, an excavator machine, such as a backhoe, is provided with an articulated boom arrangement 10 that has an outer end extension 12 often named a "dipstick." Dipstick 12 is fitted with a rearwardly-opening excavating bucket 14 that is pivotally mounted to the outer end of the dipstick 12 by means of a main pivot pin 16. Pin 16 extends through mounting lugs appropriately connected to the bucket and also extends through appropriate mounting bushings provided on the end of the dipstick. In a typical backhoe configuration, appropriate bucket pivoting linkages 18 connected to mounting lugs 20 on the bucket and to the dipstick 12 permit the to be pivoted forward and backward by means of a hydraulic cylinder 22 under the control of the backhoe operator.

Continuing to refer to FIG. 1, the bucket thumb assembly 30 of this invention comprises mounting frame 32 pivotally mounted to the bucket pivot pin 16, several gripping teeth 34 removably-mounted to mounting frame 32, and a positioning arm 36 that is pivotally connected at each end to the mounting frame 32 and to the dipstick 12. The positioning arm 36 is illustrated as a telescopically adjustable tube-in-a-tube that is pinned to the mounting frame 32 by a pin 38 that extends through mounting lugs 40 connected to the frame 32, and that is pinned to the dipstick 12 by a pin 42 that extends through mounting lugs 44 connected to the dipstick 12. Positioning arm 36 is manually adjustable to position the thumb assembly 30 in a desired position relative to the dipstick 12 and held in that position by a positioning pin 46. Pin 46 extends through both telescopic parts 35, 37 positioning arm 36 to hold the parts in their respective positions. The positioning arm function could just as conveniently be provided by a hydraulic cylinder operated from the backhoe operator's cab; although the mechanical arm illustrated is a less expensive alternative. The positioning arm or its equivalent provides a "stiff link" to hold the desired position of the thumb assembly against the forces to which it would be exposed during use.

Figure 4:
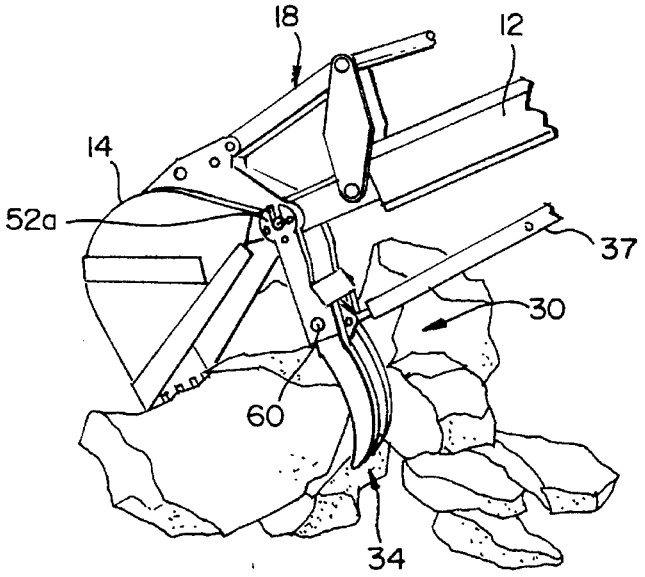
FIG. 4 is a side perspective view of the FIG. 1 apparatus illustrating the use of the thumb assembly of this invention to pick up a boulder or other object.
Figure 5:
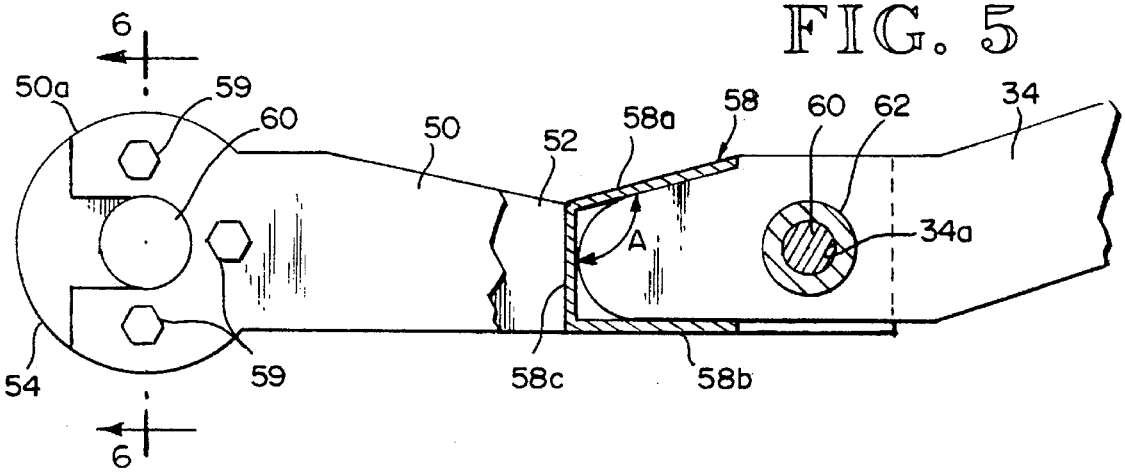
FIG. 5 is a partial side elevation view of one of the thumb assembly bucket mounting arms and the mounting arrangement for the thumb assembly's gripping teeth.
Figure 6:
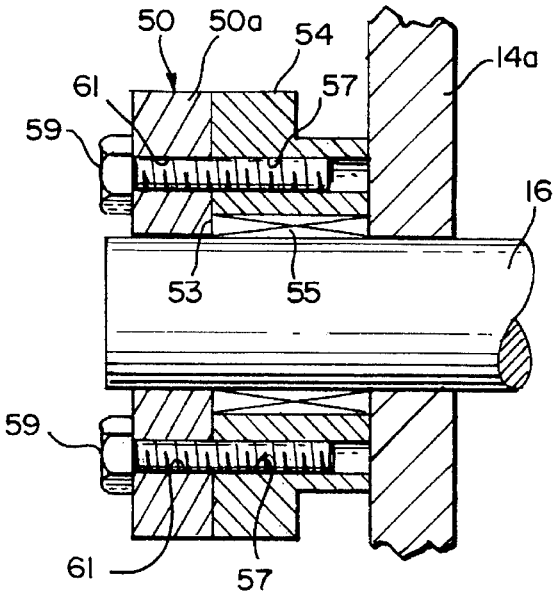
FIG. 6 is a cross-section view taken along the line 6—6 of FIG. 5 illustrating the mounting sub-assembly for mounting the thumb assembly bucket mounting arms to the excavator bucket mounting.

Now referring in particular to FIGS. 1 and 2–6, the thumb assembly mounting frame 32 comprises, looking forward from the rear toward the bucket cavity, a left and right mounting arms 50, 52, left and right bucket mounting collars 54, 56, a teeth mounting box 58, a teeth retaining pin 60, and teeth separating sleeves 62. Mounting collars 54, 56 are inserted on the ends of the bucket mounting pin 16 outside of the bucket mounting lugs 14*a*, as seen in FIG. 6, on ball-bearing bushings 55. Mounting collars 54, 56 are retained on pin 16 by slip rings 53 fitted onto pin 16 on their outer sides so that they are confined against the bucket mounting lugs. Each mounting collar 54, 56 is provided with three threaded bolt holes 57 (two being shown in FIG. 6) for bolts 59. The outer ends 50*a*, 52*a* of mounting arms 50, 52 are forked so as to provide each with a U-shaped channel having a width and a semicircular bottom diameter slightly larger than the diameter of bucket mounting pin 16. The bucket mounting pin 16 extends outward far enough on each side of the bucket sidewalls so that the forked ends 50*a*, 52*a* of mounting arms 50, 52 can be inserted over the outer ends of the pin, as seen in FIG. 6. The forked ends are provided with three bolt holes 61 to fit the bolt hole pattern in the mounting collars 54, 56. When the forked ends are inserted over the pin 16 so that the bottom ends of their respective U-shaped channels are seated against the pin 16, as shown in FIGS. 5–6, the mounting arms 50, 52 can be rotated to line up their bolt holes so that bolts 59 can be inserted and threaded into threaded holes 57, thereby fastening the mounting arms 50, 52 to the adjacent mounting collars 54, 56. The mounting arms 50, 52 are attached to the teeth mounting box 58 and aligned parallel to one another so that the entire sub-assembly of the mounting arms+mounting box can be laterally shifted into and out of engagement with the outer ends of the bucket mounting pin 16. The open-ended forks of the mounting arms enable this sub-assembly to be moved laterally into and out of engagement with the ends of pin 16 to attach or detach the thumb assembly 30 to the pin 16.

Various excavator bucket designs will have different configurations for mounting the bucket 14 to the dipstick 12. Some typically employ separate mounting lugs that are welded to the bucket casing at appropriate locations. However in all cases, the bucket design will include a main pivot pin, such as pin 16 for the present invention, by which the bucket is pivotally mounted to the end of the dipstick. However, in any given bucket design, the thumb assembly of this invention will provide side mounting arms 50, 52 that will be configured to mount to the ends of the main bucket pivot pin–however that pin is positioned –so that the sub-assembly of the mounting arms+teeth box can be laterally shifted into and out of engagement with the ends of the main pivot pin.

Now referring in particular to FIGS. 2–3 and 5, the teeth mounting box 58 of the thumb assembly mounting frame 32 comprises an elongated channel provided by inner and outer side walls and inner bottom wall, 58*a*, 58*b* and 58*c*. The ends of the channel are closed by the mounting arms 50, 52. The inner wall 58*a* extends rearward at an oblique angle from the inner bottom wall 58*c*; an oblique angle "A" of about 105° (see FIG. 5) would be suitable to help keep the teeth stably positioned within the mounting box. The outer wall 58*b* extends rearward at a right angle from the inner bottom wall 58*c*. Thus, the cross-section of the channel is that of a trapezoid.

Each tooth 34 is provided with a mounting end that is configured to closely fit within the mounting box channel as seen in FIG. 5, with the tooth outer and inner edges conforming to the box walls 58*a*, 58*b* as shown. The mounting ends of each tooth 34 are also provided with shaft holes 34*a* for receiving pin 60 as shown in FIGS. 2 and 5. When the teeth 34 are inserted into the mounting box 58, their mounting ends secure the teeth in alignment with one another and also provide a stabilizing mounting to hold the teeth in position against lateral forces that the teeth incur during use. The pin 60 is inserted also through corresponding holes 63 in the mounting arms 50, 52 so that the teeth 34 are stably mounted in the mounting box 58. Mounting box 58 and mounting arms 50, 52 are steel members welded together so that the lower ends of the mounting arms 50, 52 extend beyond the mounting box for receipt of the teeth retaining pin 60.

Several teeth 34 (four being shown in FIG. 3) are mounted by pin 60 and are spaced apart by spacing sleeves 62. Typically the spacing between teeth would be arranged so that the bucket teeth 14*b* would pass on either side of a thumb tooth 34 when the bucket was closed completely against the thumb assembly. The bucket teeth 34 could be spaced in some other pattern if desired. For example, if a backhoe bucket having the thumb assembly of this invention mounted thereon were to be used to grab and lift a number of objects of a uniform profile, such as utility vaults or pipe, etc., the profile of the teeth could be specially designed to accommodate the profile of the objects to be lifted and the spacing between the teeth 34 could also be designed to best accommodate the profile of those objects. A typical tooth profile is illustrated in FIGS. 1 and 4 for general work wherein the teeth are curved with their concavity facing the bucket cavity. FIG. 4 illustrates the bucket+thumb assembly applied to a boulder for lifting and moving. The teeth could be fashioned to be L-shaped, for example, facing the bucket cavity for engaging a corner of some rectangular object. Because the teeth can be easily and quickly removed and changed, by removing the pin 60, without affecting the bucket 14 or the thumb assembly mounting frame 32, the appropriately-configured teeth could be provided for any given job requirement.

If it is desired to remove the thumb assembly from the excavating bucket 14, the three bolts 59 on each side of the mounting arms 50, 52 would be removed and the assembly would be shifted downward and out of engagement with the bucket main pivot pin 16. The positioning arm 36 would be removed by pulling pin 42, either before or after the detachment of the mounting arms 50, 52 from the pivot pin 16, and the thumb assembly would thus be freed from the machine. It is a distinct advantage of the present invention that neither the bucket itself or its mounting need to be tinkered with or affected when the thumb assembly is attached or detached from the machine. For shipping purposes, once the positioning arm 36 has been removed from the machine, the two parts 35, 37 could be unpinned from one another and the two could be telescoped together and repinned to a shorter length. The collars 54, 56 would remain on the ends of the pivot pin 16 so that the mounting arms forked ends could be quickly and easily shifted over the pivot pin ends and aligned with the bolt holes in the collars.

Figure 7:
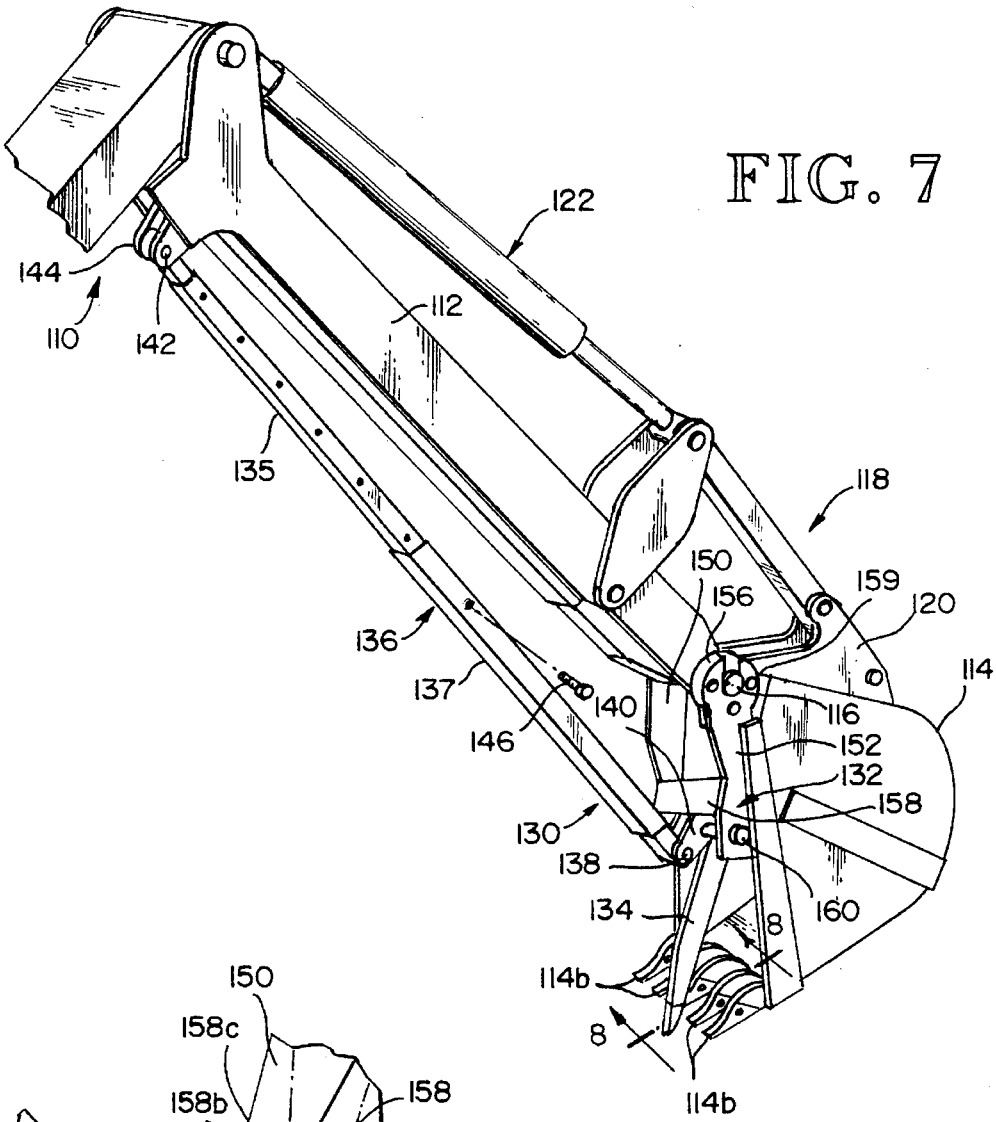
FIG. 7 is a perspective view of a backhoe excavator dip stick with a bucket mounted thereon and with the "claw" assembly of the present invention mounted to the bucket.
Figure 8:
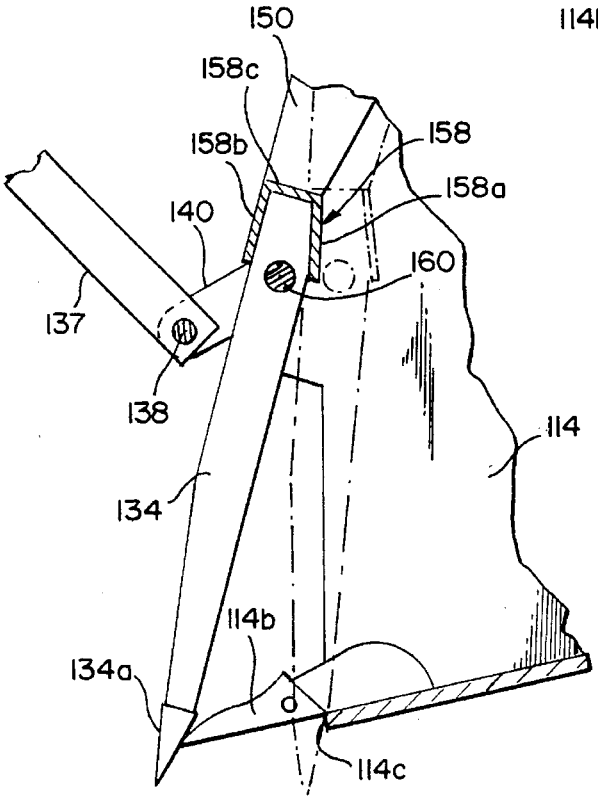
FIG. 8 is a partial view in side elevation of the FIG. 7 bucket and a ripping claw, illustrating the relationship between the bucket teeth and the claw.

With reference to FIGS. 7 and 8, an excavator machine, such as a backhoe, is provided with an articulated boom arrangement 110 that has an outer end extension 112 often named a "dipstick." Dipstick 112 is fitted with a rearwardly-opening excavating bucket 114 that is pivotally mounted to the outer end of the dipstick 112 by means of a main pivot pin 116. Pin 116 extends through mounting lugs appropriately connected to the bucket and also extends through appropriate mounting bushings provided on the end of the dipstick. In a typical backhoe configuration, appropriate bucket pivoting linkages 118 connected to mounting lugs 120 on the bucket and to the dipstick 112 permit the to be pivoted forward and backward by means of a hydraulic cylinder 122 under the control of the backhoe operator.

Continuing to refer to FIGS. 7 and 8, the bucket claw assembly 130 of this invention comprises mounting frame 132 pivotally mounted to the bucket pivot pin 116, at least one ripping tooth 134 removably-mounted to mounting frame 132, and a positioning arm 136 that is pivotally connected at each end to the mounting frame 132 and to the dipstick 112. The positioning arm 136 is illustrated as a telescopically adjustable tube-in-a-tube that is pinned to the mounting frame 132 by a pin 138 that extends through mounting lugs 140 connected to the frame 132, and that is pinned to the dipstick 112 by a pin 142 that extends through mounting lugs 144 connected to the dipstick 112. Positioning arm 136 is normally free to telescopically adjust its length, but it may be manually adjustable to position the thumb assembly 130 in a desired position relative to the dipstick 112 and held in that position by a positioning pin 146. Pin 146 may be extended through both telescopic parts 135, 137 positioning arm 36 to hold the parts in their respective positions. The positioning arm function could just as conveniently be provided by a hydraulic cylinder operated from the backhoe operator's cab; although the mechanical arm illustrated is a less expensive alternative. The positioning arm or its equivalent provides a "loose link" to permit the position of the claw assembly to be freely adjustable or, alternately, to provide a "stiff link" to hold a desired position of the claw assembly.

Still referring in particular to FIGS. 7 and 8, the claw assembly mounting frame 132 comprises, looking forward from the rear toward the bucket cavity, a left and right mounting arms 150, 152, left and right bucket mounting collars (right bucket mounting collar 156 being shown), a ripper tooth mounting box 158, and a tooth retaining pin 160. Mounting collars are inserted on the ends of the bucket mounting pin 116 outside of the bucket mounting lugs 14*a* (as seen in FIG. 6) on ball-bearing bushings 55. The mounting collars are retained on pin 16 by slip rings 53 fitted onto the pin (as seen in FIG. 6) on their outer sides so that they are confined against the bucket mounting lugs. Each mounting collar is provided with three threaded bolt holes (two being shown in FIG. 6) for bolts 159. The outer ends of the mounting arms (as seen in FIG. 5) are forked so as to provide each with a U-shaped channel having a width and a semicircular bottom diameter slightly larger than the diameter of bucket mounting pin 16. The bucket mounting pin 116 extends outward far enough on each side of the bucket sidewalls so that the forked ends of the mounting arms can be inserted over the outer ends of the pin (as seen in FIG. 6). The forked ends are provided with three bolt holes to fit the bolt hole pattern in the mounting collars. When the forked ends are inserted over the pin 16 so that the bottom ends of their respective U-shaped channels are seated against the pin 16 (as shown in FIGS. 5–6) the mounting arms can be rotated to line up their bolt holes so that bolts 159 can be inserted and threaded into threaded holes in their respective mounting collars, thereby fastening the mounting arms to the adjacent mounting collars. The mounting arms 150, 152 are attached to the tooth mounting box 158 and aligned parallel to one another so that the entire sub-assembly of the mounting arms+mounting box can be laterally shifted into and out of engagement with the outer ends of the bucket mounting pin 116. The open-ended forks of the mounting arms enable this sub-assembly to be moved laterally into and out of engagement with the ends of pin 116 to attach or detach the claw assembly 130 to the pin 116.

Now, still referring in particular to FIGS. 7 and 8, the tooth mounting box 158 of the claw assembly mounting frame 132 comprises an elongated channel provided by inner and outer side walls and bottom wall, 158*a*, 158*b* and 158*c*. The ends of the channel are closed by the mounting arms 150, 152. The inner wall 158*a* extends rearward at an oblique angle from the bottom wall 158*c*; an oblique angle "A" of about 105° (see FIG. 5) would be suitable to help keep the teeth stably positioned within the mounting box. The outer wall 158*b* extends rearward at a right angle from the inner bottom wall 158*c*. Thus, the cross-section of the channel is that of a trapezoid.

The ripper tooth 134 is provided with a mounting end that is configured to closely fit within the mounting box channel as seen in FIG. 8, with the tooth outer and inner edges conforming to the box walls 158*a*, 158*b* as shown. The mounting ends of the tooth 134 are also provided with a shaft hole for receiving pin 160 as shown in FIG. 8. When the tooth 134 is inserted into the mounting box 158, its mounting end secures the tooth and also provides a stabilizing mounting to hold the tooth in position against lateral forces that the tooth incurs during use. If more than one ripping tooth 134 is provided, when the teeth are inserted into the mounting box 158 their mounting ends secure the teeth in alignment with one another, also. The pin 160 is inserted also through corresponding holes in the mounting arms 150, 152 so that the tooth 134 is stably mounted in the mounting box 158. Mounting box 158 and mounting arms 150, 152 are steel members welded together so that the lower ends of the mounting arms 50, 52 extend beyond the mounting box for receipt of the tooth retaining pin 160.

The single ripper tooth 134 shown in FIGS. 7 and 8 is mounted between the mounting lugs 140 and therein confined and stabilized against lateral forces. In a typical installation, the location of the tooth 134 between the mounting lugs 140 would enable the tooth 134 to pass between two bucket teeth 114*b* to bear against the excavating edge 114*c* of the bucket 114 (as seen in dotted line in FIG. 8). If more than one ripper tooth 134 is to be installed, additional such teeth would be mounted on either side of the mounting lugs 140, in much the same fashion as the mounting of the gripping teeth shown in FIGS. 2 and 3, the several teeth being mounted by pin 160 and spaced apart by spacing sleeves. Typically the spacing between teeth would be arranged so that the bucket teeth 114*b* would pass on either side of a thumb tooth 134 when the bucket and bear against the bucket excavating edge 114*c*.

A typical tooth profile is illustrated in FIGS. 7 and 8 for general ripping work wherein the tooth is provided with a pointed ripping edge 134*a* extending below the bucket excavating edge 114*c* (shown in dotted line in FIG. 8) are curved with their concavity facing the bucket cavity. Because the teeth can be easily and quickly removed and changed, by removing the pin 160, without affecting the bucket 114 or the claw assembly mounting frame 132, the appropriately-configured teeth could be provided for any given job requirement.

If it is desired to remove the claw assembly from the excavating bucket 114, the three bolts 159 on each side of the mounting arms 150, 152 would be removed and the assembly would be shifted downward and out of engagement with the bucket main pivot pin 116. The positioning arm 136 would be removed by pulling pin 142, either before or after the detachment of the mounting arms 150, 152 from the pivot pin 116, and the claw assembly would thus be freed from the machine. It is a distinct advantage of the present invention that neither the bucket itself or its mounting need to be tinkered with or affected when the thumb assembly is attached or detached from the machine. For shipping purposes, once the positioning arm 136 has been removed from the machine, the two parts 135, 137 could be unpinned from one another and the two could be telescoped together and repinned to a shorter length. The mounting collars would remain on the ends of the pivot pin 16 so that the mounting arms forked ends could be quickly and easily shifted over the pivot pin ends and aligned with the bolt holes in the collars.

In the case of retrofitting an existing excavator bucket with the thumb assembly or with the claw assembly of this invention, it may be the case that the main bucket pivot pin provided with the bucket is not long enough for the ends to be exposed for attachment of the thumb or claw assembly. In this case, the main bucket pivot pin would be replaced with another pin of the same diameter and strength, only one that is long enough to protrude beyond the bucket mounting lugs (or their equivalent) so that the thumb or claw assembly could be installed as described above. The replacement pivot pin would thereafter remain a permanent part of the bucket installation; the added length of the replacement pivot pin would not be a detriment to the satisfactory operation of the excavating machine when the thumb or claw assembly is removed. The internal design of the main bucket pivot pin, such as pin 16 or 116, is such that the collar bushings 55 can be lubricated through grease fittings on the pin itself by way of internal lubricating passages in the pin.

All of the elements described above with respect to the embodiments, regarding the clamping assembly of FIGS. 1–6 and the claw assembly of FIGS. 7–8, are illustrated as being the same for each embodiment, except for the teeth 14 or 114. In the case of the clamping assembly embodiment of FIGS. 1–6, the gripping teeth 14 are configured for operating in opposition to the bucket 14 and bucket teeth 14*a* so that the entire combination functions as a clamp. In the case of the claw assembly embodiment of FIGS. 7–8, the single (or multiple) tooth 114 is configured to be engaged by and operate in cooperation with the bucket 114 and the bucket excavating edge 114*c*. Because the remaining elements of the embodiments are the same, a single system can be used as both a clamping system and a ripping system, simply by changing the teeth 14, 114.

In the case of the clamping assembly of FIGS. 1–6, the stiff link provided by the bolted tubes 35, 37 and pin 46 of the positioning arm 36 is adjusted to position the clamping teeth 14 in the desired relationship to the dipstick boom 12 to accomplish the lifting or moving task at hand; the position of the clamping teeth 14 being adjustable be telescoping adjustment of the arm 36. In the case of the claw assembly of FIGS. 7–8, however, the tubes 135, 137 would not be pinned to a fixed position, so that the positioning arm 136 would be free to telescopically adjust inward or outward; the position of the ripper tooth 114 being controlled by the position of the bucket 114 and its excavating edge 114*c*.

In the case of the claw assembly of FIGS. 7–8, a hard-surfaced material could be broken or ripped up by lowering the bucket until the ripper tooth end 134*a* engaged the surface to be broken or ripped. Then the bucket could be pivoted or carried rearward, causing the tooth 114 to be assume the dotted line position shown in FIG. 8 to abut the bucket excavating edge 114*c*. Further rearward movement of the bucket 114 would carry the tooth 114 rearward also, the tooth ripping end 134*c* being supported by the bucket excavating edge 114*c*. Because the ripping end 134*c* extends below the bucket teeth 114*b*, the tooth can rip into the surface or object below the bucket 114 to the depth of the ripping end 134*c*. In a typical application of the claw assembly embodiment of this invention, the ripper tooth 114 would be fabricated of a size such that its weight would cause it to hang substantially vertically downward from its point of suspension by pin 116. Therefore, as long as positioning arm 136 is free to telescope inward and outward, the ripper tooth 114 will always tend to return to a near-vertical position whenever the bucket 114 is pivoted forward. Consequently, the ripper tooth 114 is self-positioning to return to a ripping position with every bucket pivoting cycle during a ripping operation. In a preferred configuration of the ripper tooth 114, in profile it would have a curved, concave configuration facing rearward, the reverse of that shown in FIG. 1 with respect to the clamping teeth 14. The relatively straight-edged profile of tooth 114 shown in FIGS. 7–8 serves to illustrate the relations between the various elements.

In an alternate embodiment of the claw assembly of FIGS. 7–8, the ripper tooth 134 could be aligned with the bucket teeth 114*b* so that it would bear against one of the bucket teeth 114*b*, rather than extend between the bucket teeth to engage the bucket excavating edge 114*c*. In this embodiment, the operative ripping position of the ripper tooth 134 would that position shown in solid line in FIG. 8. In this position, the ripper tooth 134 and the bucket teeth 114*b* could operated together in a digging operation; tooth 134 first ripping into the hard-surfaced material and then the bucket teeth 114*c* digging further into the ripped open surface, all with one pivoting or scooping action of the bucket 114.

When it is desired to remove the claw assembly tooth 134 from its operative ripping position, the positioning arm 136 could be telescoped together to cause the claw assembly 130 to be pivoted upward and rearward underneath the dipstick boom 112 and stored in that retracted position by pinning the tubes 137, 137 in that retracted position with pin 146.

While the preferred embodiment of the invention has been described herein, variations in the design may be made. The scope of the invention, therefore, is only to be limited by the claims appended hereto.

The embodiments of the invention in which an exclusive property is claimed are defined as follows:

In the claims:

1. An excavating bucket attachment assembly comprising mounting means providing a pair of side arms and a tooth-mounting box; attachment means for attaching said side arms to an excavating bucket pivot pin without removing either the pivot pin or an excavating bucket to which the pivot pin is attached; and tooth means providing at least one tooth mounted in said tooth-mounting box for cooperative operation with the excavating bucket.

2. The assembly of claim 1 wherein said tooth-mounting box comprises a transverse member providing a tooth-mounting channel that extends between said side arms with said side arms attached to said transverse member and closing off said channel at opposite ends thereof; and a tooth retaining pin removably-extended through said tooth and through said side arms for retaining said tooth in said channel.

3. The assembly of claim 2 including a plurality of teeth, each mounted in said box by said retaining pin; and including spacers located between adjacent teeth, said retaining pin extending through said spacers to hold said spacers between said teeth.

4. The assembly of claim 1 including a pair of collars constructed to fit over ends of said pivot pin with said pivot pin protruding beyond said collars, said collars each being provided with at least one threaded bolt hole; and wherein said side arms are each provided with a forked end defining a slot and providing at least one bolt hole so that the slots of said side arms are insertable over the ends of said pivot pin adjacent to one of said collars and so that the side arm bolt hole is alignable with the threaded hole in the adjacent collar and fastenable thereto by a bolt inserted into both aligned holes.

5. The assembly of claim 1 wherein said tooth means provides a clamping tooth for acting in opposition to the excavator bucket for clamping objects therebetween.

6. The assembly of claim 1 wherein said tooth means provides a claw tooth for ripping a hard-surfaced material, said claw tooth having a ripping end for piercing and ripping material.

7. An excavating bucket attachment assembly comprising mounting means providing a pair of side arms and a tooth-mounting box; attachment means for attaching said side arms to an excavating bucket pivot pin without removing either the pivot pin or an excavating bucket to which the pivot pin is attached; tooth means providing a plurality of teeth in said tooth-mounting box; said tooth-mounting box comprising a transverse member providing a tooth-mounting channel that extends between said side arms with said side arms attached to said transverse member and closing off said channel at opposite ends thereof; a tooth retaining pin removably-extended through said teeth and through said side arms for retaining said teeth in said channel; spacers located between adjacent teeth, said retaining pin extending through said spacers to hold said spacers between said teeth; a pair of collars constructed to fit over ends of said pivot pin with said pivot pin protruding beyond said collars, said collars each being provided with at least one threaded bolt hole; and said side arms being each provided with a forked end defining a slot and providing at least one bolt hole so that the slots of said side arms are insertable over the ends of said pivot pin adjacent to one of said collars and so that the side arm bolt hole is alignable with the threaded hole in the adjacent collar and fastenable thereto by a bolt inserted into both aligned holes.

8. The assembly of claim 7 wherein said tooth means provides a plurality of clamping teeth for acting in opposition to the excavator bucket for clamping objects therebewteen.

9. The assembly of claim 7 wherein said tooth means provided a plurality of claw teeth for ripping a hard-surfaced material, said claw teeth having ripping ends for piercing and ripping material.

* * * * *